US007108259B2

(12) United States Patent
Chang

(10) Patent No.: US 7,108,259 B2
(45) Date of Patent: Sep. 19, 2006

(54) APPARATUS TO FEED PAPER IN AN IMAGE FORMING DEVICE

(75) Inventor: Deuk-hwan Chang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/772,287

(22) Filed: Feb. 6, 2004

(65) Prior Publication Data

US 2005/0029732 A1 Feb. 10, 2005

(30) Foreign Application Priority Data

Aug. 5, 2003 (KR) ..... 10-2003-0053976

(51) Int. Cl.
*B65H 3/32* (2006.01)

(52) U.S. Cl. ..... 271/113; 271/121; 271/167

(58) Field of Classification Search ..... 271/117, 271/118, 113, 114, 121, 167
See application file for complete search history.

(56) References Cited

U.S. PATENT DOCUMENTS 3,815,900 A * 6/1974 Schulze ..... 271/118
4,437,656 A * 3/1984 Onoda et al. ..... 271/10.12
4,484,737 A * 11/1984 Sugiyama ..... 271/264
6,315,286 B1 * 11/2001 Muenchinger et al. ..... 271/146
6,375,183 B1 * 4/2002 Inoue et al. ..... 271/10.11
6,502,816 B1 * 1/2003 Inoue et al. ..... 271/121
2002/0084573 A1 * 7/2002 Yu et al. ..... 271/116
2002/0113364 A1 * 8/2002 Hsieh et al. ..... 271/272

FOREIGN PATENT DOCUMENTS

JP 4-201933 * 7/1992
KR 10-0208140 4/1999
KR 10-0331700 8/2002

* cited by examiner

*Primary Examiner*—Kathy Matecki
*Assistant Examiner*—Thomas A. Morrison
(74) *Attorney, Agent, or Firm*—Staas & Halsey LLP

(57) ABSTRACT

An apparatus to feed paper in an image forming device, which picks up papers with various thickness received in the feeding stand without a feeding error, and transfers the same to the developing unit. The apparatus includes, a feeding stand to receive a plurality of papers, and having a separating guide inclined at a predetermined angle with which the front end of the paper makes contact with; a main pickup roller that makes contact with the paper on the uppermost layer in the upper part of the feeding stand to pick up the paper towards the separating guide using frictional force generated via rotational contact with the paper; and an auxiliary pickup roller positioned between the main pickup roller and the separating guide to apply a predetermined pressure to the paper upon picking up of the paper by the main pickup roller.

15 Claims, 5 Drawing Sheets

APPARATUS TO FEED PAPER IN AN IMAGE FORMING DEVICE

CROSS-REFERENCE TO RELATED APPLICATIONS

This application claims the benefit of Korean Patent Application No. 2003-53976 filed Aug. 5, 2003, in the Korean Intellectual Property Office, the disclosure of which is incorporated herein by reference.

BACKGROUND OF THE INVENTION

1. Field of the Invention

The present invention relates to an image forming device, more particularly, to an apparatus to feed paper in an image forming device, which picks up papers of various thicknesses in a feeding stand of the image forming device, and transfers the same to a developing unit without a feeding error.

2. Description of the Related Art

FIG. 1 is a perspective view of a conventional apparatus to feed paper in a printing apparatus that comprises: a feeding cassette 10 in which paper is received, and a pickup unit 20 to pick up the received paper.

The feeding cassette 10 receives a plurality of papers to allow the printing apparatus to sequentially perform print operations. The feeding cassette 10 has a dam-type separating guide 11 with which a front end of the paper makes contact, and the separating guide 11 is provided with at least one friction plate 12.

The pickup unit 20 is installed to the main machine of the printing apparatus (not shown) corresponding to the feeding cassette 10 provided. The pickup unit 20 includes: a pickup roller 21 to pick up the paper in the feeding cassette 10; a pickup arm 22 having a gear train to operate the pickup roller; and an operating motor 23 to deliver power to the pickup arm 22.

According to the conventional feeding apparatus, when the operating motor 23 operates according to a print signal from a controlling unit (not shown), the pickup roller 21 rotates via the gear train, and the paper is picked up by rotation of the pickup roller 21. The picked up paper P is separated and transferred by the separating guide 11 installed to a front end of the feeding cassette 10.

According to the conventional apparatus, a predetermined distance between the pickup roller 21 and the separating guide 11 is maintained regardless of the thickness of the paper, thus, overlapped transfer of papers could occur when paper with low stiffness (e.g. a thin paper) is picked up, and a printing error is generated due to a pick up error when paper with high stiffness (e.g. a thick paper) is picked up.

In addition, because the distance between the pickup roller 21 and the separating guide 11 is maintained constant, and a slope of the separating guide 11 is fixed, a high torque is required to pick up a thick paper, resulting in high power consumption and damage to the front end of the paper due to a resisting force against the separating guide 11.

SUMMARY OF THE INVENTION

Accordingly, the present invention is provided to solve the above and/or other problems of the conventional art, thus, an apparatus to feed paper in an image forming device, which picks up papers of various thicknesses in a feeding stand and transfers the same to a developing unit without a feeding error is provided.

According to another aspect of the present invention, an apparatus to feed paper in an image forming device that uniformly controls operating torque and reduces power consumption, and noise is provided.

In order to accomplish the above and/or other aspects of the present invention, an apparatus to feed paper in an image forming device includes: a feeding stand to receive a plurality of papers and having a separating guide with which a front end of the plurality of papers makes contact with; a main pickup roller installed so as to make contact with an uppermost layer of the plurality of papers in an upper part of the feeding stand to separately transfer the plurality of papers towards the separating guide; and an auxiliary pickup roller to apply a predetermined pressure to the plurality of papers upon transfer of the plurality of papers via the main pickup roller.

Additional aspects and advantages of the invention will be set forth in part in the description which follows and, in part, will be obvious from the description, or may be learned by practice of the invention.

In accordance with another aspect of the present invention, an apparatus to feed paper in an image forming device includes: a feeding stand to receive a plurality of papers, having a separating guide inclined at a predetermined angle with which a front end of the plurality of papers makes contact; a main pickup roller installed to make contact with an uppermost layer of the plurality of papers in an upper part of the feeding stand to transfer the paper towards the separating guide using frictional force generated by rotational contact with the plurality of papers; an auxiliary pickup roller positioned between the main pickup roller and the separating guide to apply a predetermined pressure on the plurality of papers upon transfer of the plurality of papers via the main pickup roller; and an exciting unit to prevent overlapped transfer of the plurality of papers by providing vibration to the plurality of papers.

According to an aspect of the present invention, a vertical pressure application force including the weight of the auxiliary pickup roller is set larger than buckling force of a paper having general thickness. Thus, buckling is induced between the auxiliary pickup roller and the separating guide by a front end resistance force of the separating guide so that the paper is picked up. And in a case where thick paper is received via the feeding stand, pickup by slipping against the separating guide is generated at the front end of the thick paper so that the auxiliary pickup roller is raised up.

Additionally, according to an aspect of the invention, the main pickup roller is installed to an end of a pickup bracket having a gear train to transfer external power to the main pickup roller, and the auxiliary pickup roller is rotatably installed to an axis of the main pickup roller via at least one supporting plate.

According to another aspect of the invention, the distance between the auxiliary pickup roller and the separating guide is within a range of 10~35 mm, and the vertical pressure application force may be in a range of 30~70 gf.

According to an aspect of the present invention, a surface of the auxiliary pickup roller comprises a friction member having more than a predetermined frictional force.

According to an aspect of the present invention, the auxiliary pickup roller is installed to run idle and rotates only when paper is transferred or operates with the same linear velocity as the main pickup roller.

Further, according to another aspect of the invention, at least two auxiliary pickup rollers are provided. And, the auxiliary pickup roller may also be provided as combination of a plurality of divided roller members.

According to another aspect of the invention, a pressure applying unit or method to generate and maintain vertical pressure application force of the auxiliary pickup roller may be provided where the pressure applying unit or method is supported via the pickup bracket at one end and is supported via the supporting plate at another end, and has an elastic member to apply pressure on the supporting plate. A torsion spring, a coil spring, or a plate spring may be used as the elastic member.

According to another aspect of the present invention, an exciting unit to prevent overlapped transfer of paper may be additionally provided. The exciting unit includes at least one cam member eccentrically connected to an axis projected from an arbitrary gear of the gear train to transfer power to the main pickup roller, and to generate vibration using disproportion of mass due to rotation of the cam member.

According to an aspect of the present invention, the exciting unit may use a vibration member.

According to yet another aspect of the present invention, the apparatus to feed paper in an image forming device includes: a feeding stand to receive a plurality of papers and having a separating guide inclined at a predetermined angle with which the front end of the plurality of papers makes contact; a main pickup roller installed to make contact with the plurality of papers on the uppermost layer in the upper part of the feeding stand to pick up the plurality of papers towards the separating guide using frictional force generated by rotational contact with the plurality of papers; and an auxiliary pickup roller positioned between the main pickup roller and the separating guide to apply a predetermined pressure on the paper when the paper is pick up by the main pickup roller, where the main pickup roller is of a cam structure having an eccentric axis, and picks up a paper in an impact manner by generating vibration upon rotation.

According to an aspect of the present invention, a vertical pressure application force including the weight of the auxiliary pickup roller is set larger than buckling force of paper having general thickness. Accordingly, in a case where the paper having general thickness is fed into the feeding stand, buckling is induced between the auxiliary pickup roller and the separating guide by front end resisting force of the separating guide so that the paper is picked up, alternatively, when thicker paper is fed into the feeding stand, pickup by slipping against the separating guide is generated at the front end of the thick paper so that the auxiliary pickup roller is raised up.

In addition, a pair of idle rollers that are rotatable are provided to the eccentric axis in order to prevent vibration occurring upon impact-picking of a paper by the cam type main pickup roller, and the idle roller may have a friction member with a surface having a predetermined frictional force.

BRIEF DESCRIPTION OF THE DRAWINGS

The above and/or other aspects advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
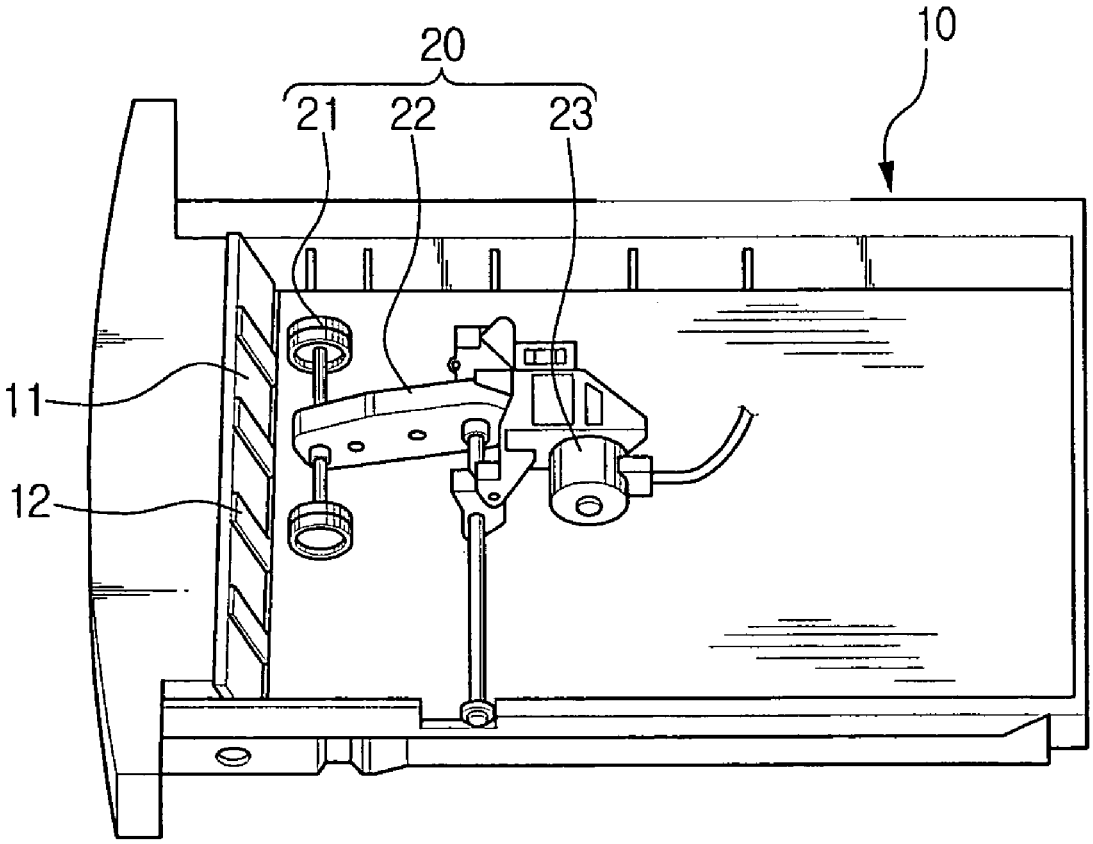
FIG. 1 (PRIOR ART)
FIG. 1 is a perspective view to show an apparatus to feed a paper in a printing apparatus according to a conventional art.

Reference will now be made in detail to the embodiments of the present invention, examples of which are illustrated in the accompanying drawings, wherein like reference numerals refer to the like elements throughout.

In the following description of the present invention, detailed descriptions of well-known functions or constructions are omitted.

Figure 2:
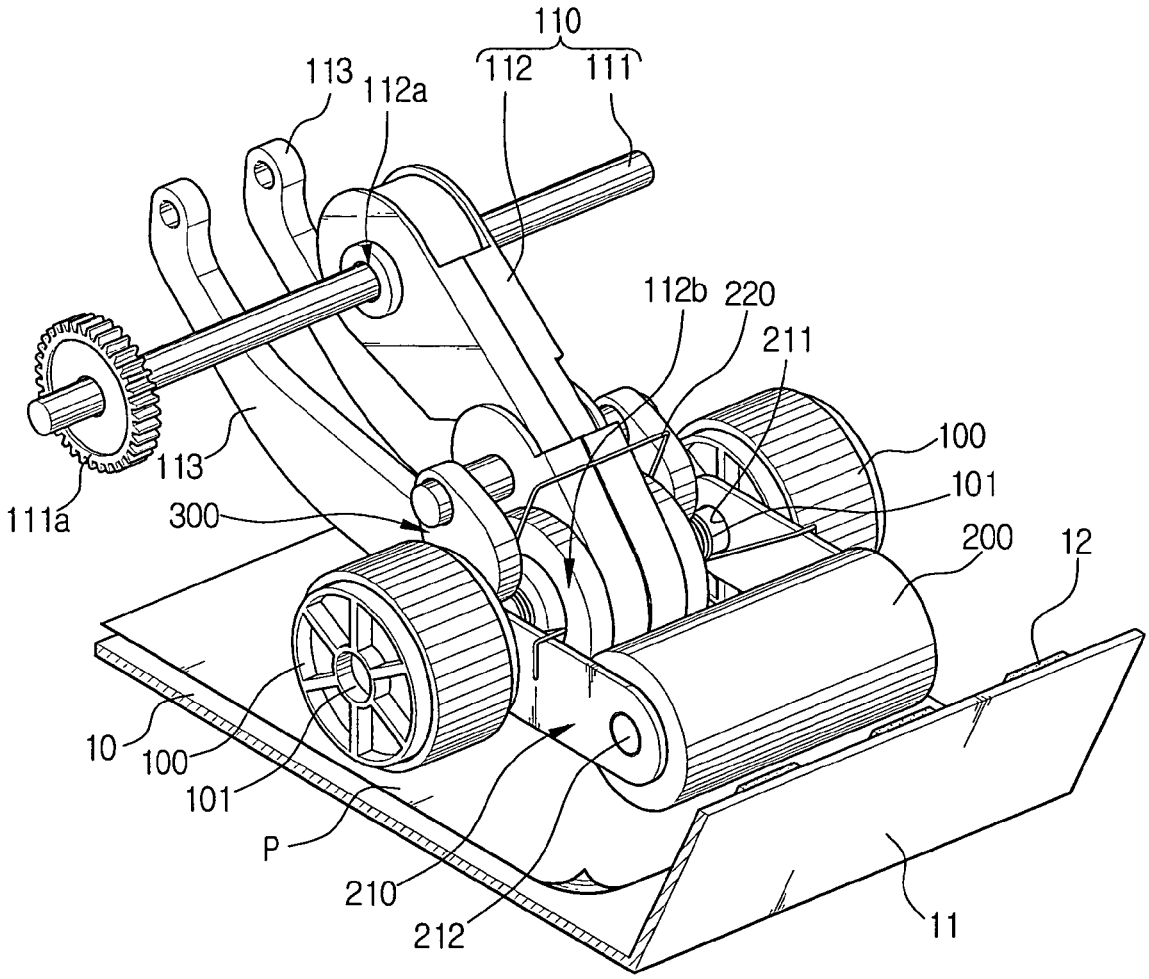
FIG. 2 is a perspective view to show an apparatus to feed paper in an image forming device according to an aspect of the present invention.
Figure 3A:
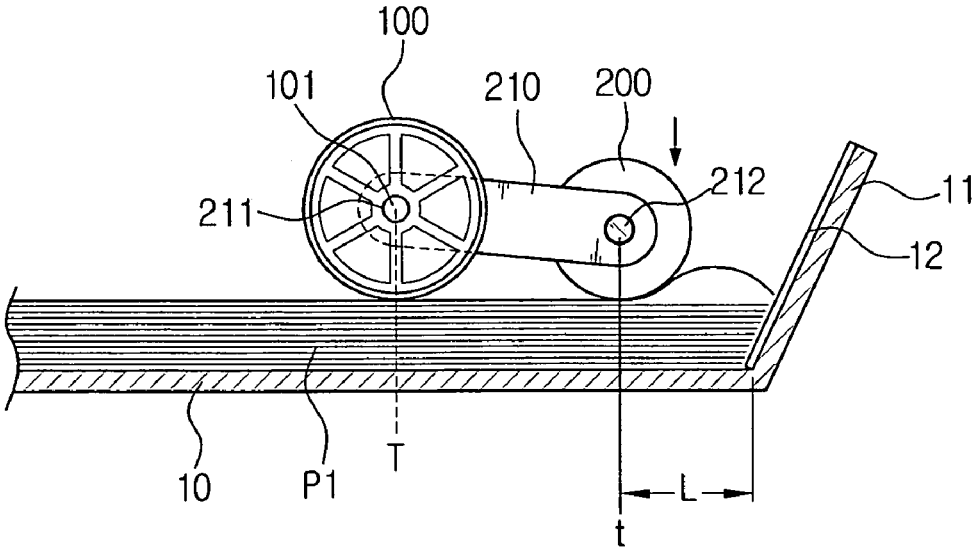
FIG. 3A is a view schematically showing feeding operation of a thin paper in an image forming device according to an aspect of the present invention.
Figure 3B:
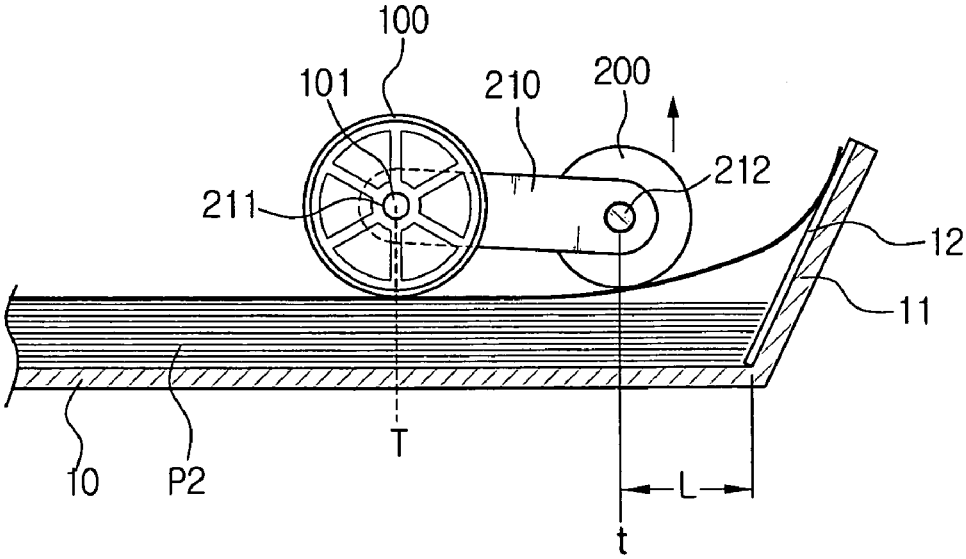
FIG. 3B is a view schematically showing feeding operation of a thick paper in an image forming device according to an aspect of the present invention.

As shown in FIG. 2 through FIG. 3B, an apparatus to feed paper in an image forming device according to an aspect of the present invention, includes: a feeding stand 10, a main pickup roller 100, and an auxiliary pickup roller 200. The feeding stand 10 is integrally formed in a frame of the image forming device (not shown), and has a separating guide 11 that makes contact with a front end of a paper P in an inner surface of the separating guide 11. The separating guide 11 has a predetermined dam-type slope, and a plurality of friction members 12 attached to the surface of the separating guide 11.

The main pickup roller 100 is provided with power via a power transferring unit 110 of a main machine of the image forming device, and rotates to pick up the paper P in the feeding stand 10.

The power transferring unit 110 includes: an operating axis 111 to transfer power from an operating source (not shown) in the main machine of the printing apparatus, and a pickup bracket 112.

A power transferring gear 111*a* is connected to the operating axis 111 to transfer power from the operating source to the operating axis 111.

The inside of the pickup bracket 112 is provided with the gear train that includes a power input part 112*a* connected to the operating axis 111, and a power output part 112*b* connected to the main pickup roller 100.

Further, one end of a pickup arm 113 is connected, in a hinge manner, to the main machine of the image forming device to support the main pickup roller 100, and the other end is connected to the power output part 112*b*. The auxiliary pickup roller 200 is installed between the main pickup roller 100 and the separating guide 11 through the pickup arm 113. The auxiliary pickup roller 200 is installed between the main pickup roller 100 and the separating guide 11 via at least one supporting plate 210 that includes a first connecting part 211 rotatably connected to the rotational axis 101 of the main pickup roller 100, and a second connecting part 212 to which the auxiliary pickup roller 200 is rotatably installed. According to an aspect of the invention the distance L between the auxiliary pickup roller 200 and the separating guide 11 is within a range of 10~35 mm.

Although pressure can be applied to the paper P in the feeding stand 10 using the weight of the auxiliary pickup roller 200, according to an aspect of the invention, the paper P in the feeding stand 10 is pressed via an elastic member having a torsion spring with one end connected to the rotational axis of the main pickup roller 100, and with another end connected to the supporting plate 210. Although a torsion spring 220 has been used for exemplary purposes, a coil spring or a plate spring could be used as the elastic member as far as elastic force is provided on the auxiliary pickup roller 200.

In addition, according to an aspect of the present invention, the apparatus to feed paper in the image forming device includes an exciting unit 300 to prevent overlapped transfer of paper by applying vibration on the paper P when the paper P is picked up by the main pickup roller 100.

The exciting unit 300, as shown in FIG. 2, has a cam member including an eccentric rotational axis to transfer vibration, due to a disproportion of mass occurring upon rotation, to the power transferring unit. The cam member is rotated via one of the gears constituting the power transferring unit 110. According to an aspect of the present invention, a pair of exciting units 300 are provided to both sides of the power transferring unit 110, and a vibration element using a piezo-electric body may be used as the exciting unit 300.

FIG. 3A and FIG. 3B show a pickup operation, which is based on thickness of a paper, performed by the apparatus to feed the paper in the image forming device according to an aspect of the present invention shown in FIG. 2. As shown in FIG. 3A, a thin paper P1 picked up via the main pickup roller 100 proceeds to the separating guide 11 while rotating the auxiliary pickup roller 200. The auxiliary pickup roller 200 is connected to the rotational axis 101 of the main pickup roller 100 through the supporting plate 210 so that the auxiliary pickup roller 200 runs idle. Because the pickup bracket 112 having the gear train does not transfer power delivered to the main pickup roller 100 to the auxiliary pickup roller 200, the auxiliary pickup roller 200 is merely rotated by frictional force created when the paper P1 picked up by rotation of the main pickup roller 100 passes through the auxiliary pickup roller 200.

The auxiliary pickup roller 200 is installed so as to maintain a predetermined interval L from the separating guide 11. As shown in FIG. 3A, when thin paper P1 is provided to the feeding stand, a front end of the paper P1 is bent between the auxiliary pickup roller 200 and the separating guide 11 to generate buckling, thereby, allowing each paper to be picked up separately. Although the main pickup roller 100 actually picks up the paper P1, pressure application force of the auxiliary pickup roller 200 that exerts pressure application force in a vertical direction to the paper P1 is relatively high compared to stiffness of the paper P1 which is thin, thus, the buckling that the front end of the paper P1 is bent while picked up, is not generated between the main pickup roller 100 and the separating guide 11, but between the auxiliary pickup roller 200 and the separating guide 11. Therefore, the auxiliary pickup roller 200 provides the same effect of picking up the thin paper P1 similar to a pickup roller that is power-operated.

As shown in FIG. 3B, when a thick paper P2 is picked up by the main pickup roller 100, the thick paper P2 proceeds to the separating guide 11 while rotating the auxiliary pickup roller 200. In this case, because the thick paper P2 has a relatively high stiffness compared to the thin paper P1, the thick paper P2 is not easily bent. Therefore, the pressure application force of the auxiliary pickup roller exerted in the direction perpendicular to the paper P2 is controlled to be lower than the stiffness of the thick paper P2 so that the auxiliary pickup roller 200 could be raised upward by the stiffness of the thick paper P2 when the thick paper P2 passes through the auxiliary pickup roller 200 while rotating the auxiliary pickup roller 200. In that case, the thick paper P2 is picked up, forming a smooth curve as shown in FIG. 3B with the front end of the paper P2 slipped against the separating guide 11 by torque applied on the application point T of the main pickup roller 100. Further, relative position of the application point T of the main pickup roller 100 to pick up the thick paper P2 is situated a rear portion of the feeding stand 10 compared to the application point t of the auxiliary pickup roller 200, thus, the main pickup roller 100 picks up the thick paper P2 by only using torque required to pick up the thin paper P1 described above. Therefore, operation noise due to load increase in the operating motor that transfers operating force to the main pickup roller 100 could be reduced and power consumption could be reduced.

Further, according to an aspect of the apparatus to feed paper in the image forming device of the present invention, because additional load due to variations in the thickness of the paper in the feeding stand 10 does not occur, an operating force applied to the main pickup roller 100 can be made constant. In addition, due to the disproportion of rotational force generated by rotation of the exciting unit 300 having the eccentric rotational axis, additional pressure application force is irregularly applied to the main pickup roller 100, whereby, vibration is generated. Accordingly, the paper P is more easily separated so that overlapped transfer of the paper is prevented.

Figure 4:
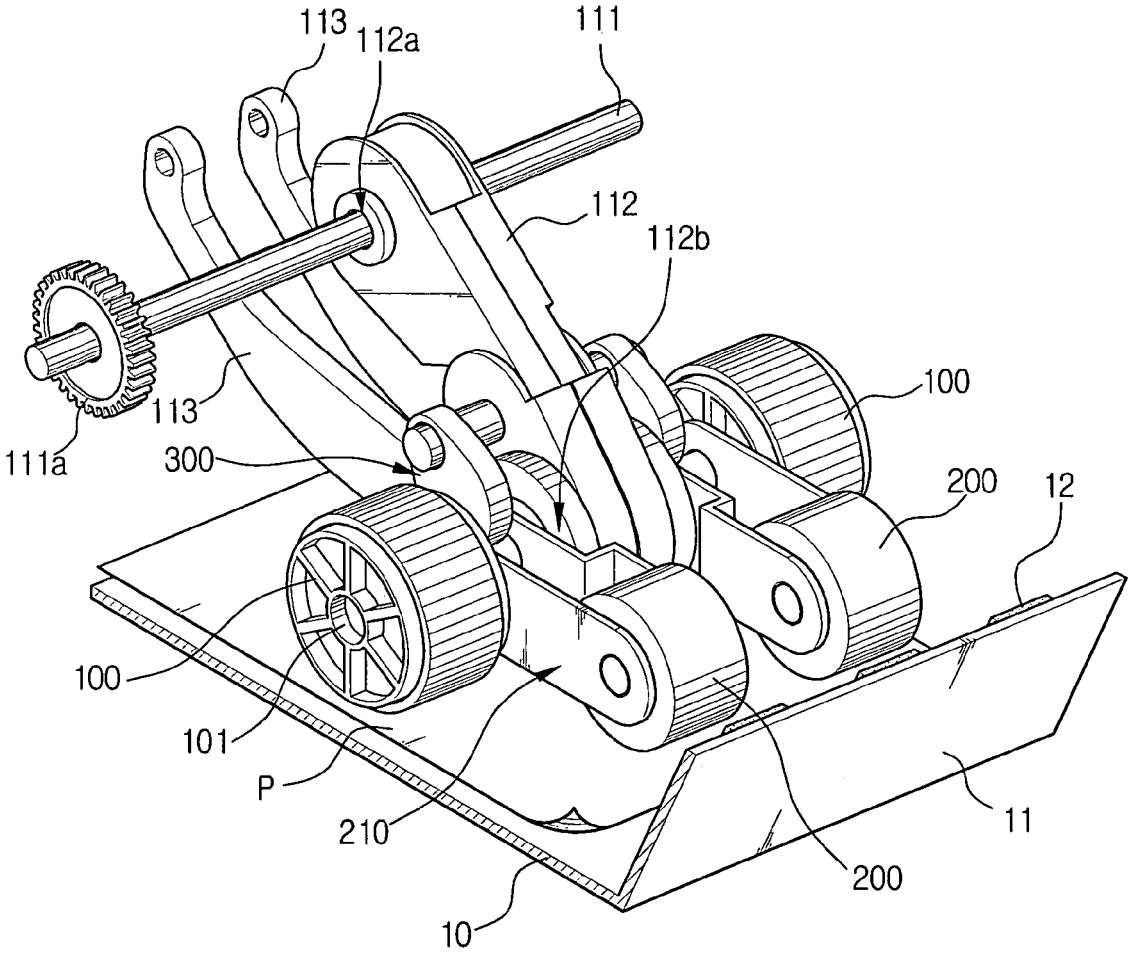
FIG. 4 is a perspective view showing an apparatus to feed a paper in an image forming device according to another aspect of the present invention.

As shown in FIG. 4, a plurality of auxiliary pickup rollers 200 are provided to the apparatus to feed paper according to another aspect of the present invention. In this case, as a contact area between the auxiliary pickup roller 200 and the paper P is reduced, pressure application force per unit area increases, but load of the operating motor could be maintained constant regardless of the thickness of the paper P, and overlapped transfer of the paper is prevented in the same manner. However, because the same pickup operation described above is used, a description thereof will be omitted.

Figure 5:
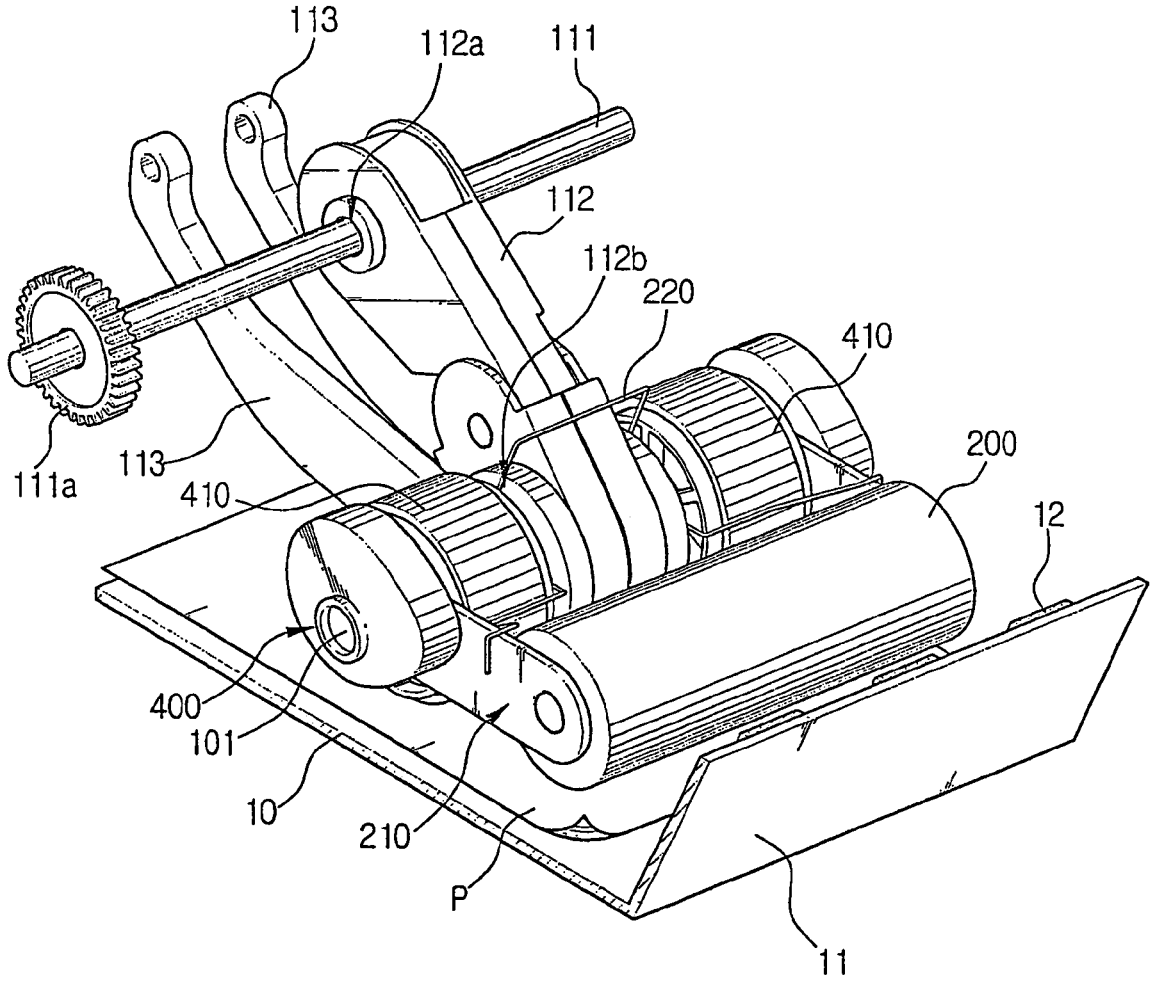
FIG. 5 is a perspective view to show an apparatus to feed a paper in an image forming device according to still another aspect of the present invention.

FIG. 5 is a drawing to show the apparatus to feed a paper in the printing apparatus having an eccentric rotational axis of the pickup roller to pick up the paper P, according to another aspect of the present invention.

The eccentric pickup roller 400 is connected to the rotational axis 101 in an eccentric manner, and picks up the paper P in the feeding stand 10, directly hitting the paper P. In this case, as the paper P makes contact with the eccentric pickup roller 400 intermittently, the whole power transferring unit 110 including the pickup bracket 112 may be shaken. Therefore, in order to prevent such shaking, an idle roller 410 is provided coaxially with respect to the rotational axis 101 of the eccentric pickup roller 400 that runs idle. In addition, the outer periphery of the eccentric pickup roller 400 is equipped with friction members similar to the above-mentioned friction members 12, which are provided to the separating guide 11, to exert resisting force over a predetermined level.

Therefore, as the paper P is hit upon during pick up by the eccentric pickup roller 400, simultaneous pick up of a plurality of papers or a printing error generated due to pickup failure is prevented. Also, unlike the aspect of the invention previously described, because the eccentric pickup roller 400 functions as the exciting unit, the exciting unit 300 is not required.

According to the apparatus to feed paper in the image forming device of the present invention, pick up failure of thick paper can be prevented, thus, torque of the operating motor is maintained constant regardless of the thickness of the paper. Therefore, noise of the operating motor generated due to load increase upon picking up of the thick paper is reduced, and power consumption of the image forming device is also reduced.

In addition, during pickup operation, the pressure application force is irregularly applied to the main pickup roller repeatedly via the exciting unit so that vibration is generated, thus, overlapped transfer of the paper that may occur when the paper is picked up, is additionally prevented.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus to feed paper in an image forming device, comprising:

a feeding stand to receive a plurality of papers;

a separating guide provided to the feeding stand inclined at a predetermined angle with which a front end of the plurality of papers makes contact;

a main pickup roller to transfer the plurality of papers towards the separating guide using a frictional force generated by rotational contact with the plurality of papers;

an auxiliary pickup roller to apply a predetermined pressure on the plurality of papers upon transfer of the plurality of papers via the main pickup roller;

a power transferring unit to provide power to the main pickup roller; and a pair of exciting units provided at each end of the power transferring unit to prevent overlapped transfer of the plurality of papers by providing vibration to the plurality of papers.

2. The apparatus according to claim 1, wherein an operating torque applied to the main pickup roller is uniformly controlled.

3. The apparatus according to claim 1, wherein a vertical application force including pressure applied by weight of the auxiliary pickup roller is set larger than a buckling force of each of the plurality of papers to induce buckling between the auxiliary pickup roller and the separating guide by front end resistance force of the separating guide.

4. The apparatus according to claim 1, wherein the plurality of papers are caused to slip against the separating guide at a front end of each of the plurality of papers so that the auxiliary pickup roller is raised up.

5. The apparatus according to claim 1, wherein the auxiliary pickup roller is rotatably installed to an axis of the main pick up roller.

6. The apparatus according to claim 1, wherein the separating guide has a predetermined slope.

7. The apparatus according to claim 6, wherein the separating guide further comprises:

a plurality of friction members attached to a surface portion of the separating guide.

8. The apparatus according to claim 1, further comprising:

a pickup arm to support the main pickup roller.

9. The apparatus according to claim 8, wherein the auxiliary pickup roller is installed between the main pick up roller and the separating guide through the pickup arm.

10. The apparatus according to claim 9, further comprising:

at least two supporting plates to support the auxiliary pickup roller between the main pickup roller and the separating guide.

11. The apparatus according to claim 10, wherein each of the at least two supporting plates comprises:

a first connecting part rotatably connected with a rotational axis of the main pickup roller; and a second connecting part to which the auxiliary pickup roller is rotatably installed.

12. The apparatus according to claim 11, further comprising:

an elastic member having a torsion spring with one end connected with the rotational axis of the main pickup roller and another end connected with each of the at least two supporting plates, to provide pressure to the plurality of papers.

13. The apparatus according to claim 1, wherein the main pickup roller is caused to operate at a constant operational force.

14. The apparatus according to claim 1, wherein an additional auxiliary pickup roller is provided to apply the predetermined pressure on the plurality of papers.

15. The apparatus according to claim 1, wherein the auxiliary pickup roller is merely rotated by frictional force created when each of the plurality of papers picked up by rotation of the main pickup roller passes through the auxiliary pickup roller.

* * * * *

UNITED STATES PATENT AND TRADEMARK OFFICE

CERTIFICATE OF CORRECTION

PATENT NO. : 7,108,259 B2
APPLICATION NO. : 10/772287
DATED : September 19, 2006
INVENTOR(S) : Deuk-hwan Chang It is certified that error appears in the above-identified patent and that said Letters Patent is hereby corrected as shown below:

Column 8, Line 5, change “pick up roller.” to --pickup roller.--

Column 8, Line 15-16, change “pick up roller” to --pickup roller--.

Signed and Sealed this

Twentieth Day of February, 2007

JON W. DUDAS
*Director of the United States Patent and Trademark Office*